United States Patent [19]

Shurland et al.

[11] Patent Number: 4,932,122

[45] Date of Patent: Jun. 12, 1990

[54] SAFETY RAZOR BLADE ASSEMBLY

[75] Inventors: Abraham Shurland, Medford; George P. Gruner, Andover, both of Mass.

[73] Assignee: The Gillette Company, Boston, Mass.

[21] Appl. No.: 135,660

[22] Filed: Dec. 21, 1987

[51] Int. Cl.[5] ..... B26B 21/00

[52] U.S. Cl. ..... 30/50; 30/346.5

[58] Field of Search ..... 30/47–50, 30/346.5, 346.58, 346.59, 346.61

[56] References Cited

U.S. PATENT DOCUMENTS 4,586,255 5/1986 Jacobson ..... 30/50

4,774,765 10/1988 Ferraro ..... 30/50

*Primary Examiner*—Douglas D. Watts

*Attorney, Agent, or Firm*—Owen J. Meegan; Aubrey C. Brine; Scott R. Foster

[57] ABSTRACT

A razor blade assembly is provided having a molded plastic body member with a guard member mounted thereon. The body member comprises wall structure defining a pair of slots for receiving a blade means, and forming a support means on which the blade means rests. The blade means comprises a pair of cantilever spring portions formed in the blade means got contacting the support means when the blade means is disposed for slidable movement in the slots whereby the blade means is resiliently mounted in the body member.

15 Claims, 4 Drawing Sheets

SAFETY RAZOR BLADE ASSEMBLY

BACKGROUND OF THE INVENTION

The present invention is directed to a safety razor implement, and more particularly to a blade assembly to be employed in a shaving implement of this type.

Razor blade assemblies have been disclosed wherein cutter edge portions of the blade means are held between skin engaging surfaces which are generally referred to as the guard and cap of the razor blade assembly. One such device is shown in U.S. Pat. No. 3,724,070 issued Apr. 3, 1973 in the name of Francis W. Dorian, Jr. In U.S. patent application Ser. No. 419,202 filed Sept. 17, 1982 in the name of Chester F. Jacobson and U.S. patent applicant Ser. No. 519,565 filed Aug. 2, 1983 in the name of Chester F. Jacobson, there are disclosed safety razor blade assemblies which have blade means individually movable within the blade assemblies in response to forces encountered during shaving operations. Blade assemblies of this type are also disclosed in U.S. Pat. No. 4,586,255 issued May 6, 1986 in the name of Chester Jacobson and U.S. Pat. No. 4,378,634 issued Apr. 5, 1983 to Chester F. Jacobson.

In the aforementioned U.S. Pat. Nos. 4,586,255 and 4,378,634, the blade members are independently movable in response to forces encountered during the shaving operation by virtue of their being supported by spring finger biasing members integral with the body member, which exercise a bias against the blades during the shaving operation.

In the construction wherein the blade support spring finger biasing members are formed integral with the body member, it is necessary to choose a material for the body member which demonstrates the proper qualities to provide a spring member, yet will demonstrate those qualities of durability necessary to provide a suitable housing for the blades, the cap and guard portion of the blade assembly. While plastic materials have been found which contain these particular qualities, regardless of the plastic which is used in the housing, when employed as a spring the material is susceptible to creep to a greater degree than that of a metal such as spring steel. It is therefore an object of the present invention to provide a razor blade assembly wherein the blade or blades are mounted for relative movement in a body member which assembly is an improvement over those blade assemblies of the prior art.

It is a further of the invention to provide a razor blade assembly wherein the blade means are provided with a spring means on the base portion thereof which is effective to permit the blade or blades to move individually within the blade assembly in response to forces encountered during the shaving operation.

Yet another object of the invention is to provide a razor blade assembly wherein the blade or blades are so constructed that the extent of deflection of the blade or blades relative to the body member is substantially controllable from one assembly to another.

Still another object of the invention is to provide a razor blade assembly having a blade means which are supported in a body member and are so constructed as to allow the deflection of the blade relative to the body member to be simply calculated.

SUMMARY OF THE INVENTION

The aforementioned objects, and other objectives which will become apparent as the description proceeds, are accomplished by providing a razor blade assembly comprising a body member, and blade means mounted on the body member for movement relative to the body member. The blade means has a base portion with a spring means formed thereon and a cutter portion, the base portion and the cutter portion defining an obtuse angle therebetween. Support means formed on the body member is disposed for contact with the spring means for support of the spring means during movement of the blade means relative to the body member.

A razor blade means for use in the razor assembly comprises a base portion with a spring means formed thereon and a cutter portion. The base portion and the cutter portion define an obtuse angle therebetween and the spring comprises a pair of elongated segments of the base portion provided by forming a laterally extending slotted openings in the base portion. Each of the elongated segments is formed such that a free end thereof extends laterally and is cantilevered from the base portion and the lower edge thereof is substantially in alignment with the lower edge of the base portion.

The blade may be formed such that the elongated segment has a depth between the slotted opening and the lower edge thereof which is of less magnitude adjacent the base portion than at the free end thereof, the depth dimension adjacent the base portion being such as to control the deflection at the free end of the segment when it is subjected to cantilever loading.

DESCRIPTION OF THE DRAWING

The foregoing and other features of the invention will be more particularly described in connection with the preferred embodiments, and with reference to the accompanying drawing, wherein.

DESCRIPTION OF THE PREFERRED EMBODIMENT

Figure 4:
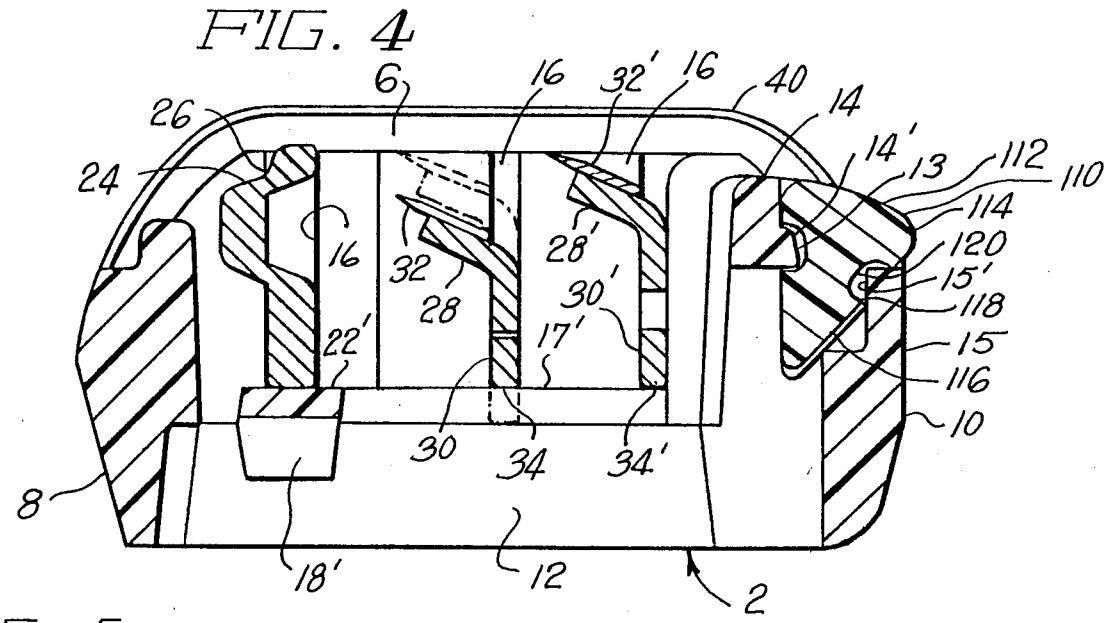
FIG. 4 is an elevational sectional view taken along the lines IV—IV of FIG. 2 showing further details of the structure of FIGS. 1 through 3.

Referring now to the drawing, and in particular to FIGS. 1 through 4, there is shown a razor blade assembly comprising a body member 2 having a first end portion 4 and a second end portion 6 interconnected by front and back portions 8 and 10 respectively. The back portion 10 of the body member 2 has an upper surface portion 14 which engages skin being shaved, behind the cutter means of the assembly, and a rear surface portion 15, as best shown in FIG. 4. The back portion 10 is provided with an elongated opening 13 defined in part by the upper surface portion 14 and the rear surface portion 15 of the back portion 10.

Each of the end portions 4 and 6 are provided with opposed slots 16 disposed transversely to the frame portion 12. One the frame portions 12 near the first end portion 4 is provided with a spring finger 18 extending therefrom generally parallel to the front and back portions 8 and 10. The finger 18 is provided with an upturned end portion 20 having an upper surface 22, and in like manner, another of the frame portions 12 near the second end portion 6 is provided with a spring finger 18' of similar configuration, with upturned end portions 20' having upper surfaces 22'. The fingers 18, 18' extend in opposite directions, the finger 18 extending toward the first end portion 4 of the body member 2 and the finger 18' extending toward the second end portion 6 of the body member. The fingers 18 and 18' are aligned with each other and with a pair of slots 16.

The first end portion 4 is provided with support means in the form of support surface 17 extending therefrom inwardly of the body member, and in like manner, the second end portion 6 is provided with support means in the form of a support surface 17' of similar configuration. The surfaces 17 and 17' extend in generally opposite directions on the same plane, the surface 17 extending from the end portion 4 generally toward the second end portion 6, and the surface 17' extending from the second end portion 6 generally toward the first end portion 4. The surfaces 17 and 17' each extend adjacent a pair of slots 16 provided in the end portion 4 and the end portion 6 respectively.

The assembly includes a guard portion 24 having a slide member 26 at either end thereof. The slide members 26 are received in a pair of opposed slots 16 nearest the front portion 8, and the bottom of the guard portion 24 rests upon the surfaces 22, 22' of the spring fingers 18, 18'. The lower edges of the slide members 26 rest above the bottoms of the slots 16 allowing the portion 24 to be moved further into the slots, against the bias of the spring fingers 18, 18' therebeneath. The spring fingers 18, 18' supporting the guard portion 24 comprise a set of support members, the object of which is to resiliently support the guard portion. In a shaving operation, the guard portion 24 travels over the surface being shaved ahead of the cutter means.

Figure 1:
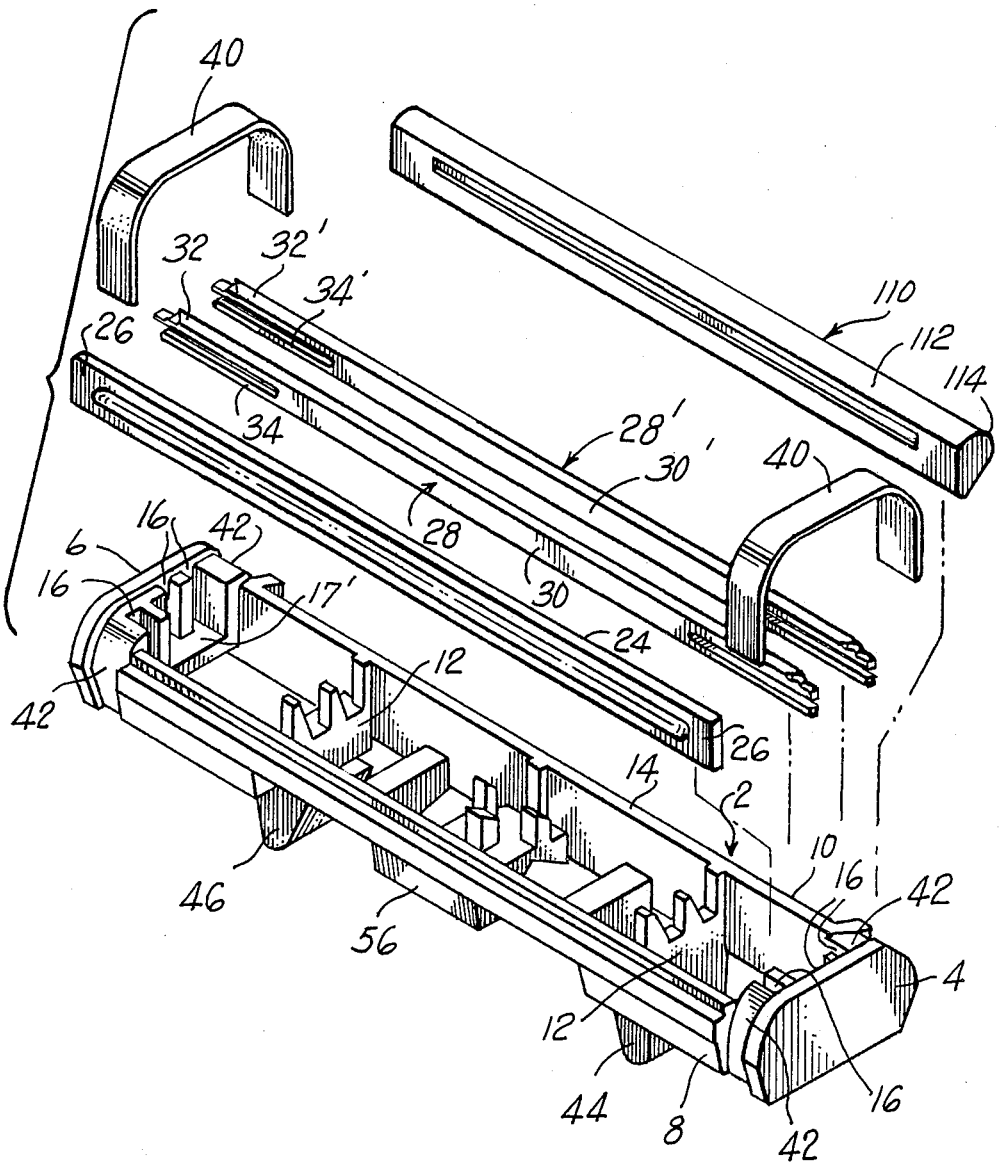
FIG. 1 is an exploded elevational perspective view showing a razor blade assembly constructed in accordance with the teachings of the present invention.
Figure 2:
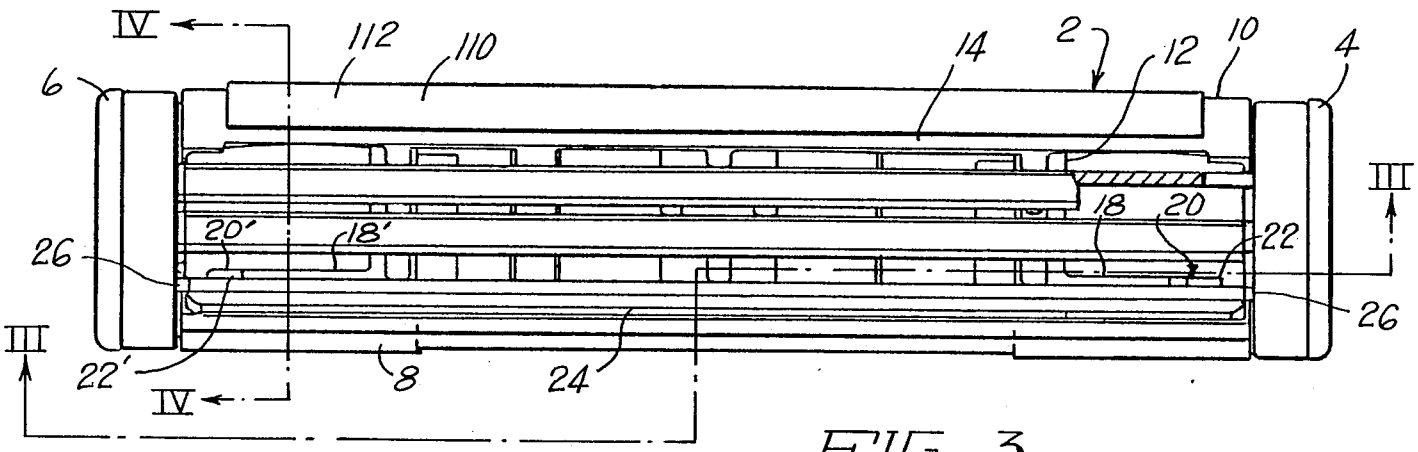
FIG. 2 is a top plan view, having portions thereof broken away, showing the razor blade assembly of FIG. 1.
Figure 3:
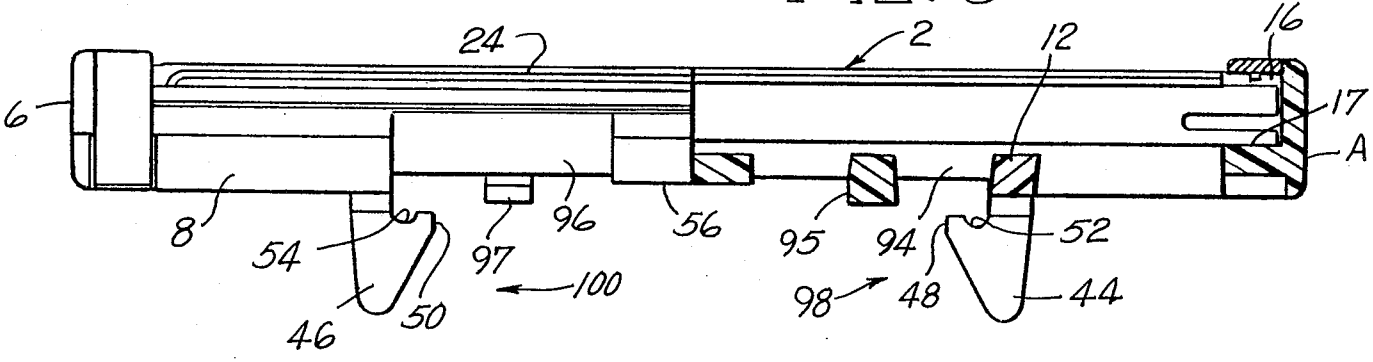
FIG. 3 is a front elevational view, partly in section, taken along the lines III—III of FIG. 2, showing details of structure of FIG. 2.
Figure 5:
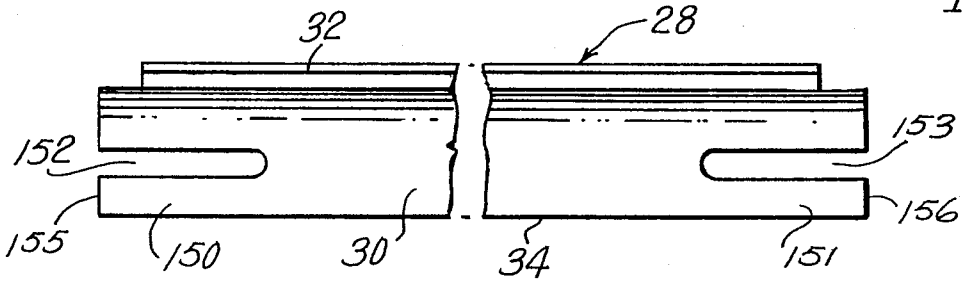
FIG. 5 is a front elevational view showing the blade element employed in the structure of FIGS. 1 through 4.

The assembly further includes blade means 28 as best shown in FIGS. 1 and 5, comprising a blade base portion 30, a cutting edge portion 32 extending from the base portion and slide portions at either end of the base portion. The slide portions are shown to be extensions of the blade base portion 30, and are received in a pair of opposed slots 16. A bottom edge 34 of the base portion 30 is engaged by a support surface 17 or 17', both the construction of the blade means 28 and its relation to the support surface 17, being explained in greater detail below.

In the embodiment illustrated, the blade means includes a second blade 28' having a base portion 30', a cutter edge portion 32' and slide portions all constructed similarly to the above-described first blade means. The slide portions of the second blade 28 are received in a third pair of opposed slots 16 nearest the back portion 10 with the bottom edge 34' of the blade base portion 30' resting on respective support surfaces 17 and 17'. In a shaving operation, the second blade 28' travels over the surface being shaved behind the first blade 28.

The guard portion 24 and first and second blades 28 and 28' are clamped in place by spring clamps 40 which are received in slots 42 in the end portions 4 and 6. The clamps 40 engage the guard portion 24 and blades 28 and 28', forcing them into the slots 16 to a point where a slight stress is placed onto the spring fingers 22 and 22' at the guard portion and on the bottom edge 34 and 34' of the blades.

On the underside of the body member 2 and the frame portions 12 are disposed two extensions 44 and 46 having at their free ends respectively inwardly extending opposed rails 48 and 50, each rail having respective arcuate upper surfaces 52 and 54. The extensions comprise a pivot mounting means by which the blade assembly may be removable and pivotably attached to a razor handle. The blade assembly body member underside is additionally provided with cam means 56 adapted to receive a cam follower operative to urge the blade assembly to a given position.

The blade assembly rails 48 and 50 in conjunction with undersurfaces 94 and 96 of the body member 2 and arcuate struts 95 and 97, define arcuate slots 98 and 100 adapted to receive razor handle shelf bearings (not shown). The shelf bearings comprise a pivot mounting means adapted to cooperate with the above-described blade assembly pivot mounting means to facilitate pivotal connection of the blade assembly to the razor handle assembly.

In the handle, there is disposed a coil spring a plunger member, the spring biasing the plunger in the direction of the free end of the plunger member. When the blade assembly is connected to the handle assembly, the free end of the plunger member is urged by the spring into engagement with the blade assembly cam means 56. During pivoting operation of the blade assembly, the plunger end bears against the cam means 56, to urge the blade assembly to a given position.

Referring to FIG. 4, it will seen that the opening 13 constitutes a gap between the back portion upper surface portion 14 and the back portion rear surface portion 15. Disposed in the opening 13 is an insert member 110 having a top surface 112 rounding into a rear surface 114 to generally form a continuation of the back portion upper and rear surface portions. The insert member 110 preferably is elongated extending over a majority of the length of the blade assembly (FIG. 2) and in cross-section includes a wedge-shaped portion 116 having a widest point 118 wider than the aforementioned gap. The wedge-shaped portion 116 is adapted to be urged through the gap and assembly to become permanently lodged in the opening 13. The insert member 110 includes a waste portion 120 adjacent the widest point 118 and adapted to receive portion 14', 15' of the back portion upper surface portion 14 and the back portion rear surface portion 15 to lock the insert member 110 in the opening 13.

The aforementioned assembly is similar to that disclosed in U.S. Pat. No. 4,586,255 issued to Chester F. Jacobson and assigned to the assignee of the present invention, with the exception of the novel blade means 28 and 28', and the novel support means which includes surfaces 17 and 17', which will be described in detail below.

Figure 6:
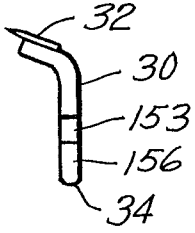
FIG. 6 is a side elevational view showing details of the structure of FIG. 5.
Figure 7:
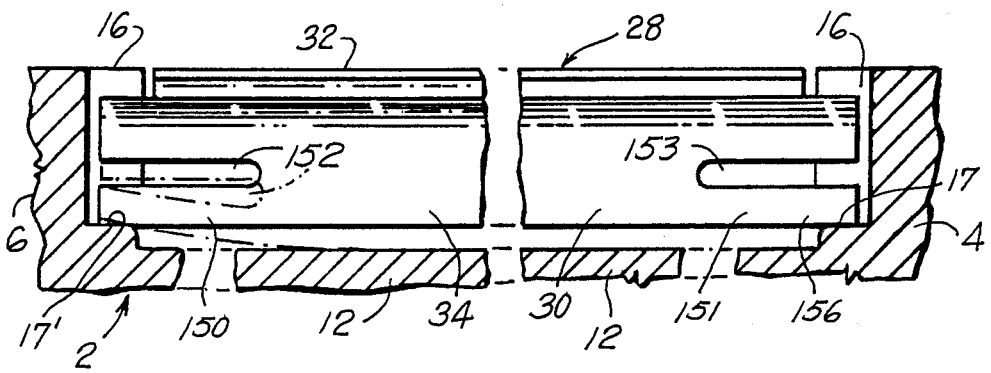
FIG. 7 is a schematic view showing selected portions of the structure of FIGS. 1 through 6 during use of the razor assembly.

Referring now to FIGS. 5 through 10 and more particular to FIGS. 5, 6 and 7, the blade 28 (or blade 28' which is identical to the blade 28) is formed such that the cutter edge portion 32 extends at an obtuse angle formed between the body member portion 30 and the cutter edge portion. The blade means 28 is provided with a spring means in the form of an elongated segment 150 and an elongated segment 151 provided by forming a pair of laterally extending slotted openings 152 and 153 in the base portion 30. The elongated segment 150, or 151, is formed such that a free end 155 and 156 respectively extends laterally and outwardly from the base portion.

Referring to FIG. 7, the blade means 28 is shown schematically supported in the body member 2 with the bottom edge 34 which produces the bottom edge of the segments 150 and 151, in spaced relation with the frame portions 12. The bottom edge 34 at the free ends 155 and 156 extend into the slots 16 and rest upon the support surfaces 17 and 17', as shown in FIG. 7. The ends 155, 156 of the blade means 28 have a freedom of movement in the slots 16 in both the vertical, and to some extent in the horizontal, direction and the segment ends 155 and 156 are free to bend as the free end of a cantilever in that there is no clamping relationship between any portion of the segments 150, 151 and the body member 2. Thus, when pressure is applied to the cutter edge portion 32 during the shaving operation, the segments 150 or 151 are free to bend, as shown in FIG. 7 in dash lines, as the free ends 155 and 156 bend in the manner of a cantilever having a free end load applied thereto at surfaces 17, 17'. The deflection of the free ends 155 and 156 may be simply calculated using well known formuli relating to the bending of cantilever beams.

Figure 8:
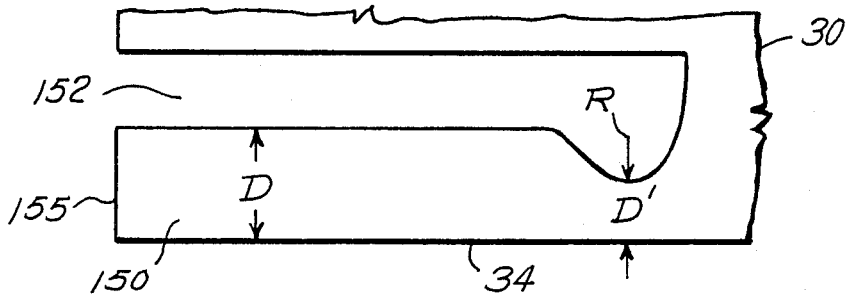
FIG. 8 is a fragmentary front elevational view showing a portion of the blade element of FIGS. 1 through 7 taken on an enlarged scale for clarity.

Referring now to FIG. 8, it will be noted that in order to control the amount of bending at the free end 155 of the segment 150, a depth D of the segment 150 is required. Should the depth of the segment be calculated to be of a smaller dimension than is required to have the end 155 stable for support within the slot 16, the depth dimension D between the slotted opening 152 and the bottom edge 34 of the base portion may be made of a less magnitude adjacent the base portion than at the free end by removing a portion of material formed by the radius R therefrom. Thus, the depth D' is effective to control the bending of the segment 155 when a cantilever load is placed at the free end 155.

Figure 9:
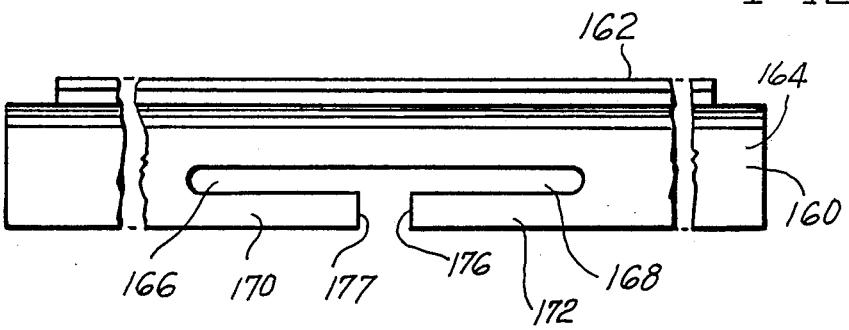
FIG. 9 is a front elevational view showing an alternate embodiment of the blade element of FIGS. 1 through 8.
Figure 10:
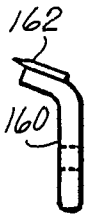
FIG. 10 a side elevational view showing details of the structure of FIG. 9.

In FIG. 9, there is shown an alternate embodiment of the blade means 28 in which a blade means 160 is provided with a cutter edge portion 162 and a base portion 164. In this embodiment, a pair of elongated slots 166 and 168 are disposed adjacent the centerline of the blade means 160 and in opposed relation with one another. The slotted openings 166 and 168 are effective to form a pair of elongated segments 170 and 172 having free ends 174 and 176. As in the previous embodiment, the segments 170 and 172 form a spring means for supporting the blade assembly 160.

In the previous embodiment shown in FIG. 7, the support surfaces 17 and 17' are positioned above the frame portions 12 and the support surfaces retain the free ends of the segments 150 and 151 when pressure is applied to the blade assembly 28, and the frame portions 12 serve as stops by contacting the bottom edge 34 of the blade means to control movement of the blade means within the slots 16. In the present embodiment shown in FIG. 9, the frame members 12 are positioned higher than the surfaces 17 and 17' and the free ends 174 and 176 are positioned to contact the upper surface of the frame members 12 which become supports for the blade means 160, and the surfaces 17 and 17' being lower than the frame upper surfaces, contact the blade means 160 and provide a stop for the blade means, to control movement of the blade within the slots 16.

During a shaving operation, the guard portion 24 moves independently of the blades 28 and 28' (or blades 162) against the bias of the springs fingers 18 and 18'. The blades 28 and 28' (or the blades 62) also move independently of one another and of the guard portion 24 by flexure of the elongated segments 150 and 151 (or 170 and 172) while the assembly passes over the area to be shaved. Simultaneously, the blade assembly, as a whole, pivots on the handle following the contours of the surface being shaved. When the insert members 110 comes in contact with water, the hydrosphilic material leaches out of the insert member and is deposited on the surface being shaved.

From the foregoing, it should be evident that the present invention provides a shaving assembly, and blade means for use in the assembly, which are simply constructed and perform with a high degree of reliability. By employing a blade means having the spring means formed from the blade material, it is not necessary to choose a material for the body member 2 having particular spring characteristics other than those necessary for housing the blades. The designer is therefore allowed to choose from a number of materials which do not have spring characteristics required to control movement of the blades within the body member and may apply other criteria in making his selection.

We claim:

1. A razor blade assembly comprising:

a body member;

blade means mounted on said body member for movement thereon, said blade means having a base portion with a spring means formed thereon and a cutter portion, said base portion and said cutter portion, said base portion and said cutter portion defining an obtuse angle therebetween;

support means formed on said body member disposed for contact with said spring means for support of said spring means during movement of said blade means relative to said body member;

said spring means comprising an elongated segment of said base portion provided by forming a laterally extending slotted opening in said base portion, said elongated segment formed such that a free end thereof extends laterally, and is cantilevered from said base portion and the lower edge thereof is aligned with the lower edge of said base portion; and said blade means being mounted in said razor blade assembly such that said elongated segment free end rests on said support means and said base portion lower edge is in spaced relation with said body member allowing movement relative to said body member.

2. A razor blade assembly as set forth in claim 1 wherein said blade means comprises first and second blade members, each of said blade members having a respective base portion with a spring means formed thereon and a cutter portion defining an obtuse angle therebetween whereby said first and second blade means are movable relative to said body member and movable relative to each other.

3. A razor blade assembly as set forth in claim 1 wherein said spring means comprises a second elongated segment of said base portion provided by forming a second laterally extending slotted opening in said base portion, each said elongated segment formed such that a free end thereof extends laterally, and is cantilevered from said base portion and the lower edge thereof is substantially in alignment with the lower edge of said base portion, said blade means being mounted in said razor blade assembly such that said free end of each of said elongated segments rests on said support means and said base portion lower edge is in spaced relation with said body member allowing movement relative to said body member.

4. A razor blade assembly as set forth in claim 1 wherein said support means comprises shelf structure formed in said body member having a surface facing said blade means and positioned for contacting said spring means.

5. A razor blade assembly as set forth in claim 3 wherein said slotted openings are each disposed at opposite sides of said base portion and said free ends extend outwardly from said base portion.

6. A razor blade assembly as set forth in claim 3 wherein said slotted openings are each disposed adjacent the center of said base portion and said free ends are in facing relation, one with the other.

7. A razor blade assembly as set forth in claim 3 wherein each said elongated segment has a depth dimension between said slotted opening and the lower edge thereof which is of less magnitude adjacent said base portion than at said free end.

8. A razor blade assembly as set forth in claim 1 wherein said body member is formed of molded plastic material and said blade means comprises a steel material.

9. A razor blade assembly as set forth in claim 2 wherein said support means comprises a pair of shelf structures, one for each of said blade members formed in said body member, each shelf structure having a surface facing its respective blade member and positioned for contacting a respective free end of one of said elongated segments.

10. A razor blade assembly as set forth in claim 9 wherein each of said slotted openings is disposed at an opposite side of a respective blade member base portion and said free ends thereof extend outwardly from said base portion.

11. A razor blade assembly as set forth in claim 10 wherein each said elongated segment has a depth dimension between said slotted opening and the lower edge thereof which is of less magnitude adjacent said base portion than at said free end.

12. A razor blade for use in a safety razor assembly comprising:

a base portion with a spring means formed thereon and a cutter portion, said base portion and said cutter portion defining an obtuse angle therebetween, said spring means comprising a pair of elongated segments of said base portion provided by forming a pair of laterally extended slotted openings in said base portion, each said elongated segment formed such that a free end thereof extends laterally, and is cantilevered from said base portion and the lower edge thereof substantially is aligned with the lower edge of said base portion.

13. A razor blade as set forth in claim 12 wherein said slotted openings are each disposed at opposite sides of said base portion and said free ends extend outwardly from said base portion.

14. A razor blade as set forth in claim 12 wherein said slotted openings are each disposed adjacent the center of said base portion and said free ends are in facing relation, one with the other.

15. A razor blade as set forth in claim 12 wherein each said elongated segment has a depth dimension between said slotted opening and the lower edge thereof which is of a less magnitude adjacent said base portion than at said free end.

* * * * *